US006513209B1

(12) United States Patent
Portzline

(10) Patent No.: US 6,513,209 B1
(45) Date of Patent: Feb. 4, 2003

(54) FASTENING SYSTEM FOR A BRA

(75) Inventor: Carey Portzline, Portland, OR (US)

(73) Assignee: Nike, Inc., Beaverton, OR (US)

( * ) Notice: Subject to any disclaimer, the term of this patent is extended or adjusted under 35 U.S.C. 154(b) by 0 days.

(21) Appl. No.: 09/689,747

(22) Filed: Oct. 13, 2000

(51) Int. Cl.[7] ..... A41F 1/00; F16B 45/00

(52) U.S. Cl. ..... 24/701; 24/698.1; 450/82; 2/73

(58) Field of Search ..... 24/695, 696, 698.1–701; 36/50.1, 50.5; 450/1, 9, 15, 17, 26, 28, 33, 35, 58, 82, 86; 2/73

(56) References Cited

U.S. PATENT DOCUMENTS

| | | | | | |
|---|---|---|---|---|---|
| 2,978 | A | * | 2/1843 | Atwood | 24/698.3 |
| 506,494 | A | * | 10/1893 | Harrison | 24/698.1 X |
| 658,115 | A | | 9/1900 | Murray | |
| 658,184 | A | * | 9/1900 | Leib | 24/695 |
| 687,973 | A | * | 12/1901 | Bohn | 24/695 |
| 731,019 | A | | 6/1903 | Chandler | |
| 905,825 | A | * | 12/1908 | Bunnell | 24/695 |
| 1,202,090 | A | | 10/1916 | Naylor | |
| 1,272,857 | A | * | 7/1918 | Russ | 24/682.1 |
| 3,162,919 | A | * | 12/1964 | Shee | 24/695 |
| 3,426,400 | A | * | 2/1969 | Lauro | 53/471 |
| 3,936,914 | A | * | 2/1976 | Mancini | 24/698.2 X |
| 4,437,212 | A | * | 3/1984 | Stahl et al. | 24/698.2 |
| 4,444,191 | A | | 4/1984 | Harned | |
| 5,221,227 | A | | 6/1993 | Michels | |
| 5,357,659 | A | * | 10/1994 | Acherman | 24/662 |
| D355,294 | S | | 2/1995 | Bussey et al. | |
| 5,826,313 | A | * | 10/1998 | Ishizaki | 24/695 X |
| 6,023,785 | A | | 2/2000 | Johnson | |
| 6,209,177 | B1 | * | 4/2001 | Murasaki | 24/452 |

FOREIGN PATENT DOCUMENTS

| | | | | |
|---|---|---|---|---|
| GB | 0 649 367 | * | 1/1951 | 24/698.1 |

* cited by examiner

*Primary Examiner*—Robert J. Sandy
*Assistant Examiner*—Ruth C. Rodriguez
(74) *Attorney, Agent, or Firm*—Banner & Witcoff, Ltd.

(57) ABSTRACT

A fastening system for an article of apparel, advantageously a bra, including first and second coupling members attached to ends of a hemband. The coupling members are movable between an engaged or locked state when the bra is worn and a disengaged state to remove the bra. The coupling members are integrally molded and each includes a stitch plate and a plurality of locking members. The locking members on one coupling member are hooks while the other are loops. The coupling members have a flex groove formed therein between their locking members to make the coupling members more flexible. The flex groove may optimally extend across the stitch plates to further enhance flexibility. The ends of the hooks are angularly displaced from their stitch plates. This raises the interlocking locking portions away from the back of the wearer to increase comfort. Additionally, the hooks include opposed angled guide surfaces. The opposed angled guide surfaces each have a parallel guide surface on an adjacent hook.

19 Claims, 6 Drawing Sheets

FASTENING SYSTEM FOR A BRA

FIELD OF THE INVENTION

The present invention relates to a two-part fastening system for items of apparel and other articles. More specifically, the present invention relates to a simplified fastening system for a sports bra that facilitates the attachment and separation of mating fastening elements.

BACKGROUND OF THE INVENTION

Brassieres, or bras as more commonly referred to, are garments worn by women to cover and support their breasts. Bras commonly include a front portion to cover the breasts, a portion that extends around the back, and shoulder straps connecting the front and rear portions so that the front portion can better support the breasts. Either the rear portions or front portions are usually joined in the center by a fastening system that includes one or more pairs of small metal hooks and eyes formed of wound wires. This type of fastening system has been used for many years. However, the bras using this fastening system are difficult to put on and take off for many wearers.

With rear fastening bras, some wearers put their bra on by attempting to mate the hooks with their respective loops in a blind operation with their arms behind their back. This can be very difficult to do with most bras as the hooks and loops require individual intricate manipulation. Other wearers put their bra on by attaching the hooks and loops in view in the front of their body. Once this step is completed, they must rotate the bra around their body to properly orient the bra for support and bend their arms to feed them through openings. This step can be often be difficult, especially when the wearer has limited arm movement. Further, this step can be extremely difficult when the bra has extremely high elastic properties which exist with many bras, such as sports and jogging bras.

Therefore, an improved fastening system for an article of apparel was needed. More specifically, a bra with a fastening system was thus needed which would simplify the process of putting on and taking off a bra. In particular, an improved fastening system for a sports bra, which provides more support and is more tight fitting than the average bra, was thus needed. The present invention was developed to accomplish these and other objectives.

SUMMARY OF THE INVENTION

In view of the foregoing, it is a principal object of the present invention to provide an improved fastening system which can be used with bras, other articles of apparel, and other articles.

More specifically, it is an object of the invention to provide an improved fastening system for a bra that simplifies the process of putting on and taking off a bra, such as a sports bra. Such an arrangement is beneficial as many times the attachment and detachment is done in a blind operation.

Additionally, it is another object of the invention to provide a fastening system of a bra having enlarged hooks and receiving members and parallel guiding surfaces. Such an arrangement facilitates attachment and detachment and maintains a tight fit during an attached state.

These and other objects are achieved by the present invention which, according to one aspect, provides an article of apparel having first and second portions and a fastening system. The first and second portions being adapted to cover a portion of a body of a wearer. The fastening system removably couples the first and second portions together. The fastening system includes a first coupling member attached to the first portion and a second coupling member attached to the second portion. Each of the first and second coupling members have a base and two spaced apart locking members. The two locking members of the first coupling member are attached to and extend from the base of the first coupling member. The two locking members of the second coupling member are attached to and extend from the base of the second coupling member. Each locking member of the first coupling member is shaped and disposed to interlock with a respective locking member of the second coupling member. The first coupling member includes a groove between its first and second locking members to enhance flexibility of the first coupling member between its locking members. The second coupling member also includes a groove between its first and second locking members to enhance flexibility of the second coupling member between its locking members.

In yet another aspect, the invention provides an article of apparel having first and second portions and a fastening system. The first and second portions being adapted to cover a portion of a body of a wearer. The fastening system removably couples the first and second portions together. The fastening system includes a first coupling member attached to the first portion and a second coupling member attached to the second portion. The first coupling member includes a section proximal to the first portion lying in a first plane and a section distal from the first portion having a hook. The second coupling member having a section proximal to the second portion lying in a second plane and a section distal from the second portion. The distal section of the second portion forming a part of a loop and being raised from the second plane. The first and second coupling members is movable between an engaged state wherein the hook of the first coupling member lockingly engages the loop of the second coupling member to couple the first and second portions of the apparel together, and a disengaged state wherein the first and second portions of the apparel are freely movable with respect to each other. The first and second planes are substantially coplanar when the coupling members are in an engaged state.

In another aspect, the invention provides an article of apparel having first and second portions and a fastening system. The first and second portions being adapted to cover a portion of a body of a wearer. The fastening system removably couples the first and second portions together. The fastening system includes a first coupling member attached to the first portion and a second coupling member attached to the second portion. The first coupling member has a first locking member and a second locking member. The first and second locking members of the first coupling member have a hook including a receiving slot. The first coupling member is integrally formed with its first and second locking members. The second coupling member has a first locking member and a second locking member. The first and second locking members of the second coupling member include a loop being at least partially formed by a support having first and second guiding surfaces and a locking surface disposed between the first and second guiding surfaces. The first guiding surface of the first locking member of the second coupling member is substantially parallel to the first guiding surface of the second locking member of the second coupling member. Further, the second guiding surface of the first locking member of the second coupling member is substantially parallel to the second guiding surface of the second locking member of the second coupling member. The second coupling member is integrally formed with its first and second locking members. The first and second coupling members are movable between a first locked state whereby the hooks of the first coupling member lockingly engage respective locking surfaces of the second coupling member to couple the first and second portions of the apparel together, and a second unlocked state whereby the first and second portions of the apparel are freely movable with respect to each other.

It is another object of the present invention to provide a fastening system with the features and benefits as described herein. The fastening system is preferably, but not necessarily, used with articles of apparel.

These and other objects and features of the invention will be apparent upon consideration of the following detailed description of preferred embodiments thereof, presented in connection with the following drawings in which like reference numerals identify like elements throughout.

DETAILED DESCRIPTION OF THE PREFERRED EMBODIMENT

Figure 1:
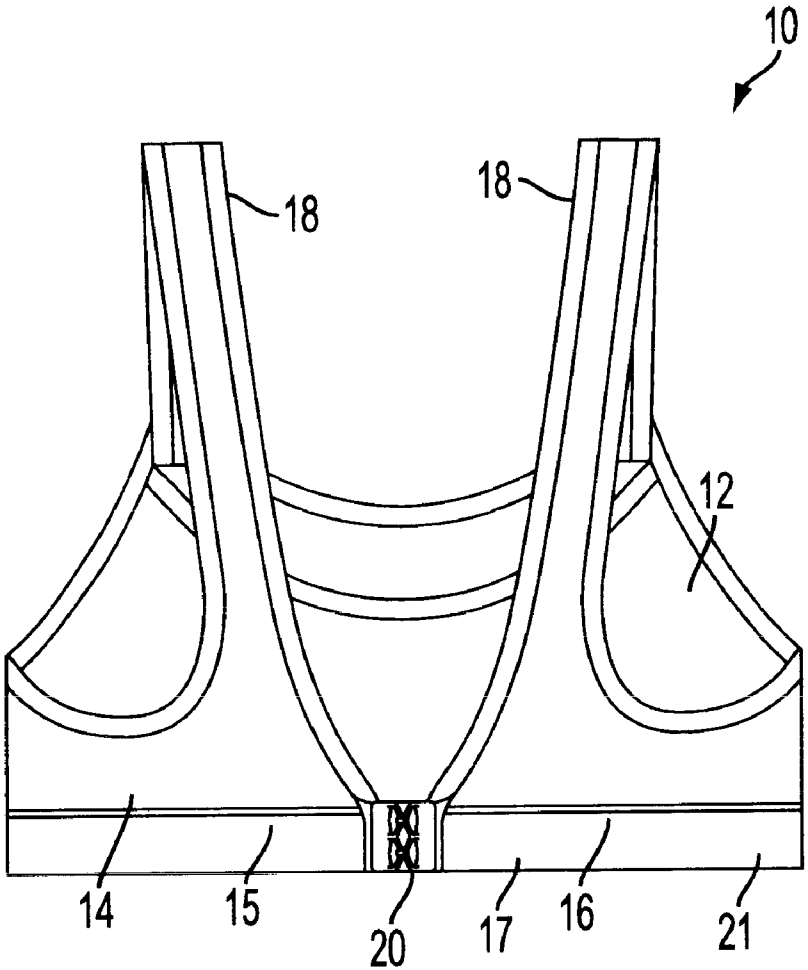
FIG. 1 is a rear elevational view of the bra and fastening system of the present invention.
Figure 3:
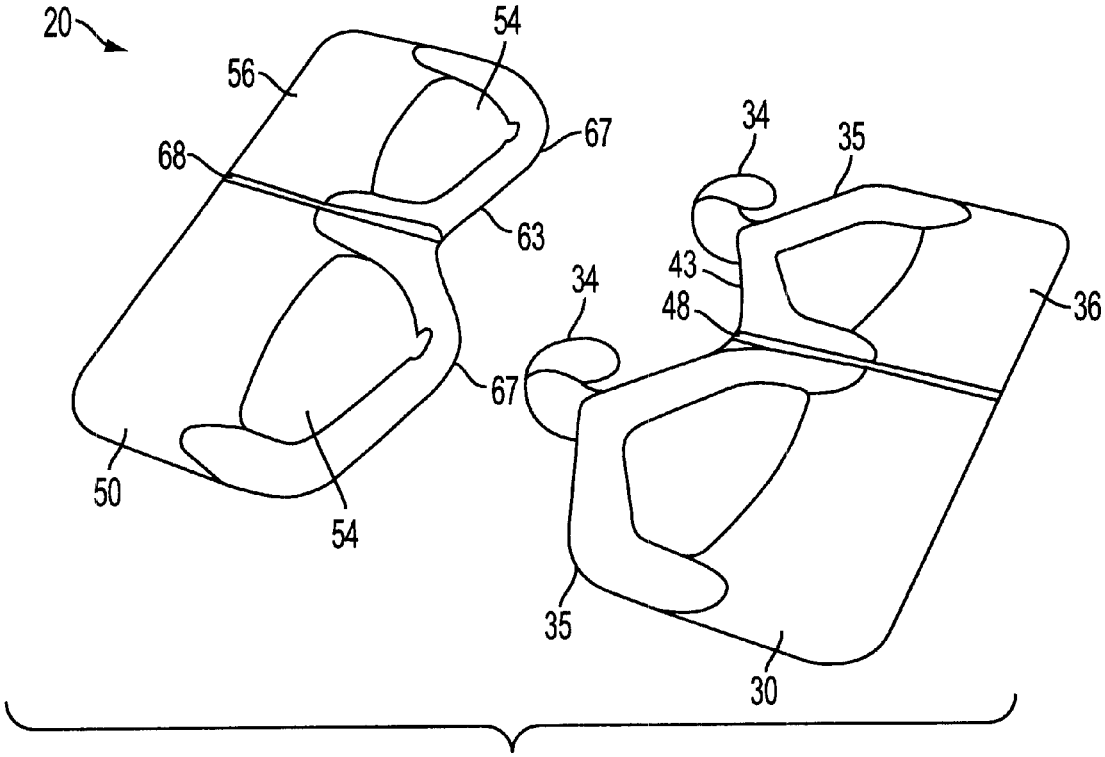
FIG. 3 is a schematic view of the two fastening pieces in a separated state.

In the present invention, as pictured in FIGS. 1–13, a bra is designated generally by reference numeral 10. The bra 10 is a garment to be worn by women to cover and support the breasts. In a preferred arrangement, the bra 10 is designed to be worn during sports activities of the sports bra-type and includes a front portion 12 that covers the breasts, a rear left portion 14 and a rear right portion 16, and a pair of shoulder straps 18, each for attaching the front portion 12 to a respective rear portion 14, 16. The left and right rear portions 14 and 16 each include respective end portions 15 and 17 adjacent to one another. These end portions can be selectively attached and separated from one another by the use of a fastening system 20 to put on and take off the bra 10. The end portions 15 and 17 are preferably end portions of a hemband 21 and each preferably include pull tabs 19 to which one half of the fastening system 20 is attached.

The fastening system 20 is preferably a two-piece fastening system and includes a pair of coupling members referred to herein as a first extending or projecting element or piece 30 and a second receiving element or piece 50. The two pieces 30 and 50 matingly interlock. When interlocked or in an engaged state, the mating pieces 30 and 50 keep the bra 10 fastened. The tension of the hemband 21 will maintain the pieces 30 and 50 in an engaged state while it is being worn. The pieces 30 and 50 are disengaged to take off the bra.

Figure 4:
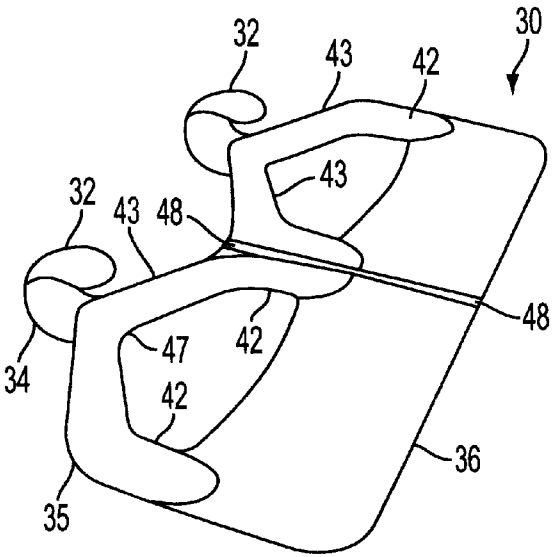
FIG. 4 is a perspective view of the projecting piece of the fastening system.
Figure 7:
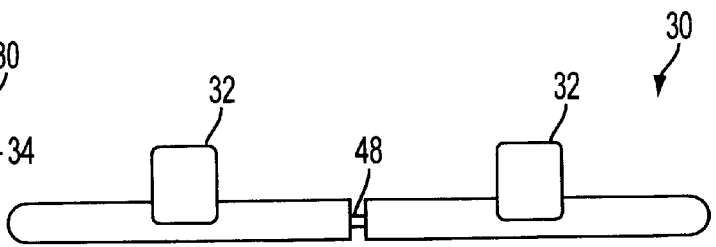
FIG. 7 is a side elevational view of the projecting piece of the fastening system (view referenced as if in a fastened orientation)
Figure 5:
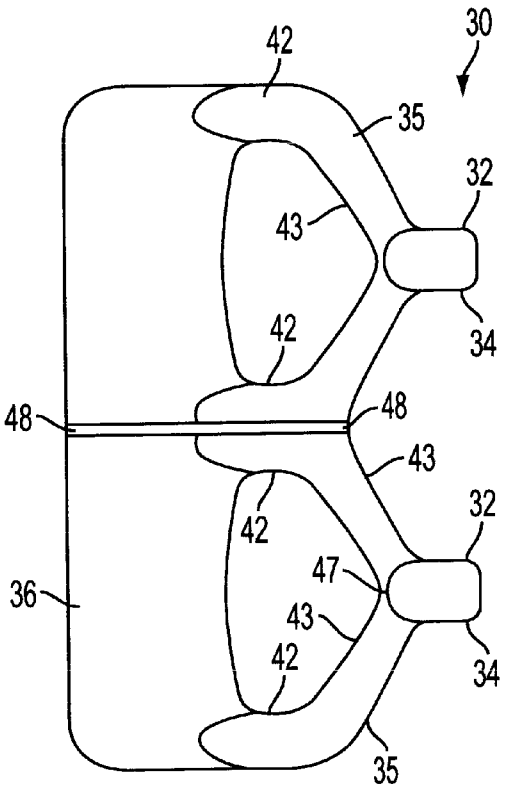
FIG. 5 is a rear elevational view of the projecting piece of the fastening system (view referenced as if in a fastened orientation)
Figure 6:
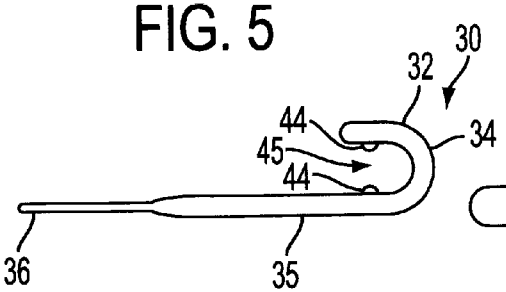
FIG. 6 is a top plan view of the projecting piece of the fastening system (view referenced as if in a fastened orientation)
Figure 8:
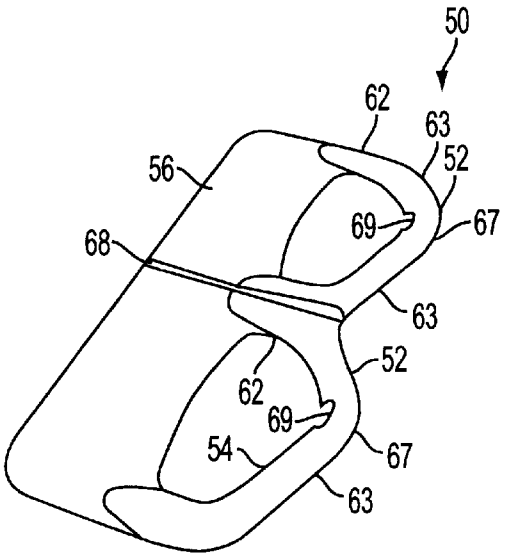
FIG. 8 is a perspective view of the receiving piece of the fastening system.

The first interlocking piece 30 of the fastening system 20, as shown in FIGS. 4–7, preferably includes a base region formed by a stitch plate or tab 36 and plurality of hooking elements 32. Each hooking element 32 includes a hook 34 and a brace support 35 coupling the hook 34 to the plate 36. As shown in FIGS. 4 and 5, each brace support 35 preferably includes horizontal extension portions 42 extending from the plate 36, and angled portions 43 extending from the end of the horizontal extension portions 42 distal from the plate 36. It should be noted that the terms horizontal and vertical as used herein references the elements of the closure system 20 in a fastened position relative to the bra 10 being worn by a user. Thus, for example, the plate or tab 36 will lie in a generally vertical plane when the bra 10 is worn. The angled portions 43 join at an apex 47 from which a respective hook 34 extends. As can be seen in FIGS. 4 and 6, each hook 34 includes a receiving slot 45 for receiving a portion of the second piece 50 of the fastening system 20. In a preferred arrangement, locking projections or bumps 44 may be disposed in the receiving slot 45 to help prevent inadvertent separation of the interlocking pieces 30 and 50.

The second interlocking piece 50 of the fastening system 20, as shown in FIGS. 8–11, preferably includes a base region formed by a stitch plate or tab 56 and a plurality of receiving or loop elements 52. Each receiving or loop element 52 includes a loops 54 that receives a respective hook 34 from the first fastening piece 30 for fastening the bra 10. Each loop 54 preferably is formed by a molded member that forms the loop 54. Each loop 54 is formed by a pair of horizontal extensions 62 generally extending away from the plate 56, a pair of angled extensions 63 extending from the ends of the horizontal extensions 62 toward each other, and an apex 67 located where the angled extensions 63 meet. Each apex 67 is designed to extend into a respective receiving slot 45 when the fastening system 20 is in a fastened position. The loops 54 are relatively large and generally triangular in shape to assist in the fastening process.

The angled extensions 63 of the loop 54 act to guide the hook 34 to the apex 67 in the event that there is an initial misalignment. This guiding ability is facilitated by the tension of bra material and its hemband 21 which pulls the hook 34 along the angled extension 63. The upper angled extension 63 of the upper loop element 52 is parallel to the upper angled extension 63 of the lower loop element 52. The same parallel relationship exists with the lower angled extensions 63. This enables the guide surfaces of adjacent loop elements 52 to work together to guide the hooks 34 into their respective apexes 67.

Figure 9:
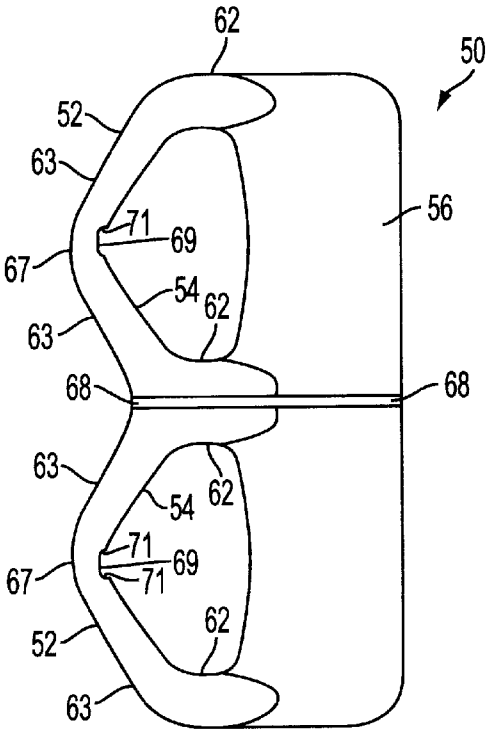
FIG. 9 is a rear elevational view of the receiving piece of the fastening system (view referenced as if in a fastened orientation)
Figure 12:
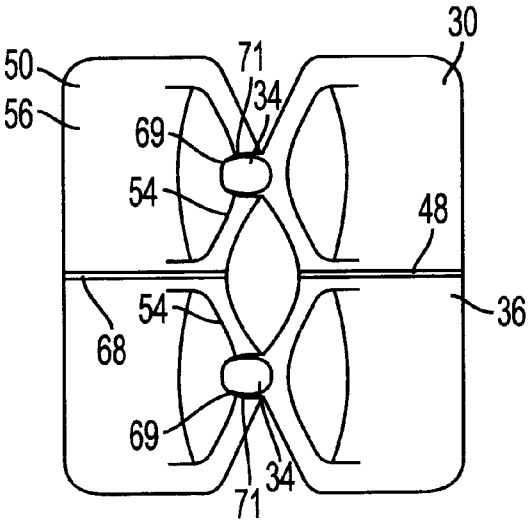
FIG. 12 is a rear elevational view of the receiving and projecting pieces of the fastening system in a locked state.

If desired, as shown in FIGS. 9 and 12, the edges of each apex 67 may be molded to include shoulders 71 forming a groove 69 therebetween. The shoulders 71 aid in centering its respective interfacing hook 34 with respect to its apex 67 and minimizes the possibility of undesired separation between the fastening elements 30 and 50 under normal wearing conditions. The groove 69 is slightly larger than the width of the hook 34 so that the shoulders 71 act to center the sides of the hook 34. The groove 69 also shapes the apex 67 such that its thickness $t_1$ relative to the receiving slot 45 when the projecting and receiving pieces 30 and 50 are in a fastened position is greater than its thickness $t_2$ relative to the receiving slot 45 when the receiving piece 50 is pivoted an amount between 5° and 50° relative to the projecting piece 30. This configuration assists in maintaining the locked state between the pieces 30 and 50 during normal wearing conditions and facilitates the unfastening process as separation between the elements 30 and 50 is made easier as the receiving piece 50 may be pivoted prior to unfastening.

Figure 11:
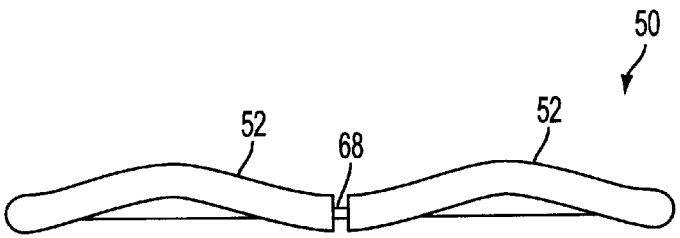
FIG. 11 is a side elevational view of the receiving piece of the fastening system (view referenced as if in a fastened orientation)
Figure 10:
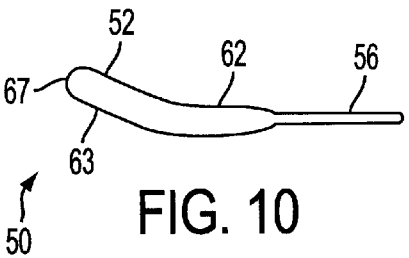
FIG. 10 is a top plan view of the receiving piece of the fastening system (view referenced as if in a fastened orientation)
Figure 13:
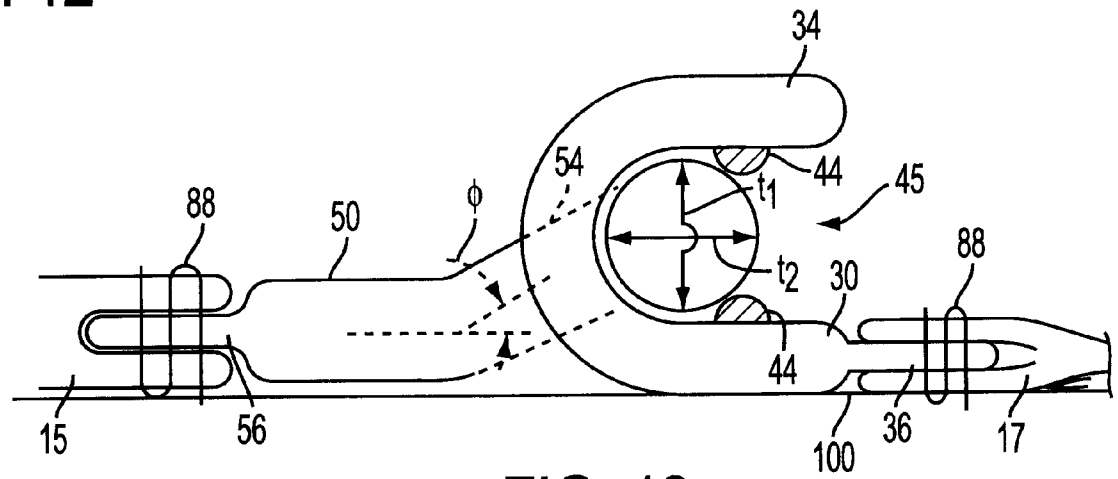
FIG. 13 is a top plan view of the receiving and projecting pieces of the fastening system in a locked state.

As seen in FIGS. 10, 11 and 13, the horizontal extensions 62 generally lie in a vertical plane. This plane is generally coincident with the plane of the tab 56. As such, the horizontal center lines of the horizontal extensions 62 and the tab 56 may be coincident. In another preferred arrangement, the horizontal center line of the horizontal extensions 62 may be slightly offset from the horizontal center line of the tab 56 so that the inner surfaces of each, that contact and face the wearer's back when the bra 10 is worn, lie in the same plane. As seen in the figures, for both the projecting piece 30 and the receiving piece 50, the horizontal and angled extensions 42 and 43 and 62 and 63 are thicker than the tab 56.

Figure 2:
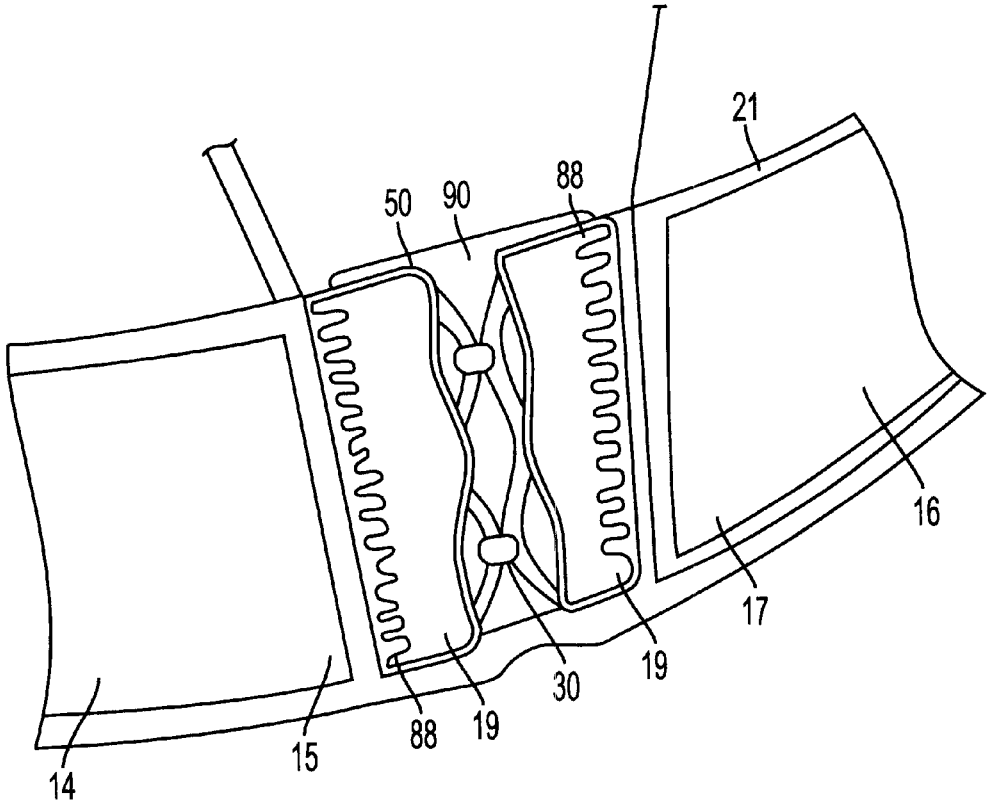
FIG. 2 is a rear perspective view of the region of the bra including the fastening system.

The angled extensions 63 lie in a plane that is angularly displaced from the plane of the horizontal extensions 62. Thus, the angular extensions 63 extend away from the plane defined by the horizontal extensions 62. As shown in FIG. 13, these planes are separated by an angle θ. This angle of separation θ is preferably within the range of 20°–50°, and is more preferably about 35°. This offset spaces both the mating fastening features, that is the receiving slot 45 of the hook 34 of the projecting piece 30 and the apex 67 of the receiving piece 50, away from the back 100 of the wearer. As shown in FIG. 13, when the bra 10 is fastened and being worn, these mating fastening features 45 and 67 are spaced from the back 100 such that, in the region of the fastening system 20, the back 100 of the wearer is contacted only by the generally vertical, front facing surfaces 72 and 74 of the respective horizontal extension portions 42 and 62, and by the material of the bra in the end portions 15 and 17 of the left and right rear portions 14 and 16 of the bra 10. Further, if desired, soft backing material 90, as shown in FIG. 2, may be attached to the skin facing surface of pull tabs 19 or any other desirable portion and extend in the region between the fastening system 20 and the skin of the wearer.

The fastening pieces 30 and 50 are preferably provided with flex grooves 48 and 68 between adjacent hooking elements 32 and between adjacent loop elements 52. This provides enhanced flexibility between the bottom and top of each fastening piece 30 and 50 as it provides the ability of each adjacent pair of hook elements 32 and each adjacent pair of loop elements 52 to flex relative to each other along the line formed by the flex grooves 48 and 68. In a preferred arrangement, the flex grooves 48 and 68 are formed by providing reduced thickness portions along desired lines in the molding process. In a preferred embodiment, the reduced thickness portions may be between 5%–50% of the thickness of the horizontal extensions 42 and 62. The flex grooves 48 and 68 act as hinges for each of the fastening pieces 30 and 50. The grooves 48 and 68 of the fastening pieces 30 and 50 provide the enhanced ability to flex along the grooves 48 and 68 and thus enables the fastening system 20 to more closely match the contour of the back 100 of the wearer from top to bottom. This, in turn, will provide increased comfort, and minimize undesirable chafing and high pressure points. Further, when fastened, the flex grooves 48 and 68 will also be in alignment with each other so that both pieces 30 and 50, when in an engaged state, can better match the contour of the back 100 of the wearer. As shown in FIGS. 3–4 and 8–9, the flex groove 48 and 68 extend to provide recessed portions between horizontal extensions 42 and 62 of adjacent hooking elements 32 and loop elements 52. If desired, as shown, the flex grooves 48 and 68 may be extended across the tabs 36 and 56 to provide enhance flexibility in the tabs 36 and 56. However, since the tabs 36 and 56 are preferably thin relative to the hooking and loop elements 32 and 52, the tabs 36 and 56 may be inherently flexible and the flex grooves 48 and 68 need not extend across the tabs 36 and 56 to provide sufficient flexing capability.

The tabs 36 and 56 are thin flexible members and serve as stitch plates. This facilitates the attachment of the ends portions 15 and 17 of the material to the fastening pieces 30 and 50. In one preferred arrangement, the end portions 15 and 17 are directly sewn to the tabs 36 and 56 by stitching 88. However, other attachment techniques may be used. The large flat surface area of each of these tabs 36 and 56 distributes the forces over a larger area to provide a more even tensioning force. As previously indicated, the tabs 36 and 56 may optionally be provided with reduced thickness flex grooves 48 and 68 to further increase the hinging capability of the fastening pieces 30 and 50.

Thus, each of the fastening pieces 30 and 50 are unitary and integrally formed. This provides certain advantages. Besides minimizing part and assembly costs, the integrally molded pieces 30 and 50 ensure tight tolerances between the parallel angled extensions 42 and 62 of adjacent hooks and loops 34 and 54 so that all of the hooks 34 and loops 54 of the fastening system 20 will snap together during the fastening process due to the tensioning of the material and the guiding surfaces of the angled extensions 42 and 62. In a preferred embodiment, the fastening pieces 30 and 50 are each made of nylon. However, it is recognized that other suitable plastics may be used. Further, in a preferred method of manufacture, the fastening pieces 30 and 50 are injection molded. However, other molding techniques may be used.

In use, to put on the bra 10, the wearer will place her head between the shoulder straps and her arms is the shoulder straps and place the front 12 and rear of the bra 10 such that the front 12 of the bra 10 is centered over her breasts. Behind her back, in a blind operation, she positions each of the hooks 34 within its respective loop 54. As the generally-triangular loops 54 are wide open, locating the hooks 34 relative to the loops 54 is facilitated. The hooks 34 need merely to be inserted in the loops 54 between the top of the upper horizontal extension 62 and the bottom of the lower horizontal extension 62. Once this is done, the elasticity of the bra material, specifically the hemband 21, pulls each hook 34 to the center of its respective apex 67 with the horizontal extensions 62 acting as centering guides if the hooks 34 are positioned above or below their apex 67. The plastic projections or bumps 44 help the hooks 34 and loops 54 snap in place and prevent inadvertent unfastening. The shoulders 71 also help prevent inadvertent movement between the hooks 34 and loops 54. As the fastener is under tension of an elastic hemband 21 while being worn, the fastening pieces 30 and 50 do not separate during use. To unfasten the bra 10, the user merely pushes the hooks 34 and loops 54 toward each other while pivoting the two parts to release the closure. This too can easily be performed in a blind operation.

The bra 10 may be designed for general use or a specialized usage, such as a jogging or sports bra. In such a preferred embodiment, the material of the sports bra 10 provides elastic properties and such suitable materials may include spandex and a blend of polyester and spandex. A liner fabric may also be used in the breast covering regions if desired.

Figure 14:
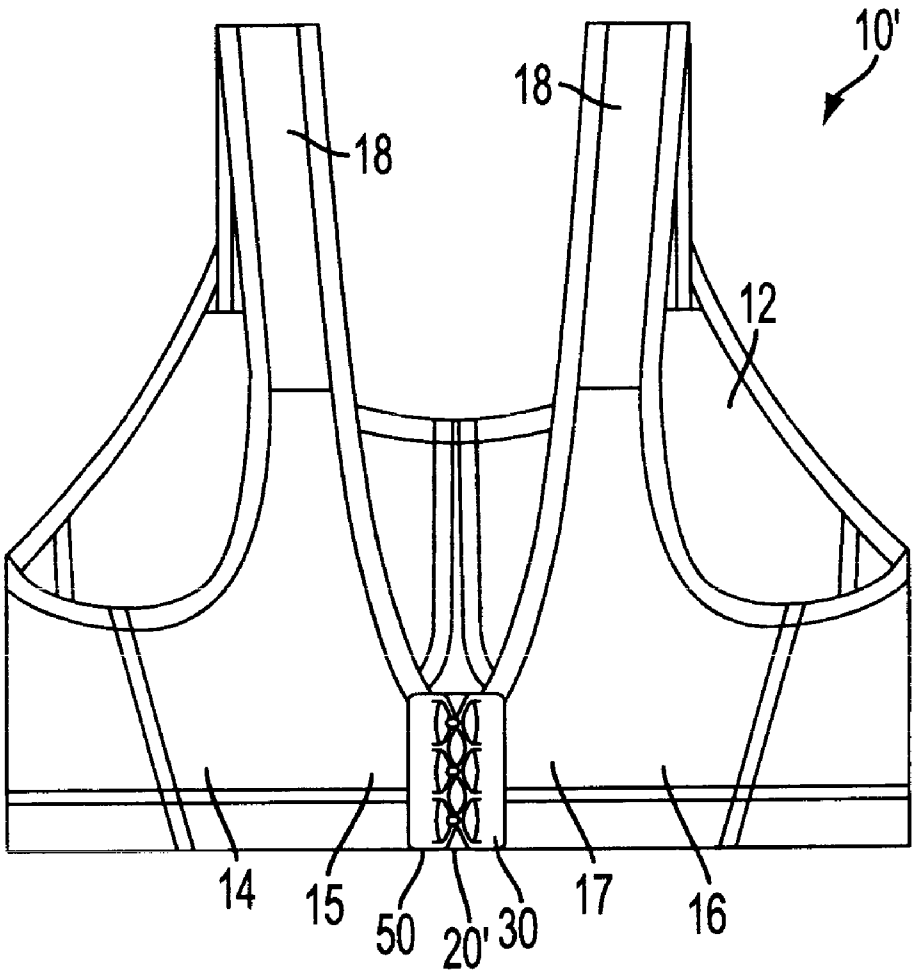
FIG. 14 is a rear elevational view of the bra and fastening system of the present invention with the fastening pieces having three engaging elements.

FIG. 14 shows a bra 10' similar to that of FIG. 1, except that the interlocking pieces 30 and 50 of its fastening system 20' have three integrally-molded pairs of hook and loop elements 32 and 52 instead of two. Flex grooves 48 and 68 are preferably positioned between each adjacent pair of hook and loop elements 32 and 52 as previously described. It is recognized that one pair of hook and loop elements 32 and 52, or more than three pairs of hook and loop elements 32 and 52, could also be used in lieu of the two and three pair arrangements depicted in the figures.

While particular embodiments of the invention have been shown and described, it is recognized that various modifications thereof will occur to those skilled in the art. For example, while the fastening system 10 is located at the back of the bra 20, it could also be used as a front closure system for a front closing bra. The integral flex grooves 48 and 68 remain an added benefit in a front closing bra as conformance to the skin for comfort and elimination of undesired pressure points and chafing are more important concerns. Further, while the fastening system 20 is useful for a bra 10, it is can also be used as a fastening system for other articles of apparel such as pants having an elastic waistband, or suspenders, or anything that puts the closure in tension when worn. Therefore, the scope of the herein-described invention shall be limited solely by the claims appended hereto.

What is claimed is:

1. An article of apparel comprising:

first and second portions, said first and second portions adapted for covering a portion of a body of a wearer; and a fastening system, said fastening system adapted for removably coupling said first and second portions together, said fastening system including a first coupling member attached to said first portion of the article and a second coupling member attached to said second portion of the article, said first coupling member including a section proximal to the first portion lying in a first plane and a section distal from the first portion having a hook, said second coupling member having a section proximal to the second portion lying in a second plane and a section distal from the second portion, said distal section of said second portion forming a part of a loop and being raised from said second plane, said part of the loop having a first guiding element substantially intersecting a second guiding element at an angle less than 180 degrees and forming an apex of the loop therebetween, said distal section of said second coupling member defines a plane that is angularly displaced from said second plane, said first and second coupling members being movable between an engaged state wherein the hook of said first coupling member lockingly engages said loop of said second coupling member to couple said first and second portions of the apparel together, and a disengaged state wherein the first and second portions of the apparel are freely movable with respect to each other, said first and second planes being substantially coplanar when said coupling members are in an engaged state.

2. The article of apparel of claim 1, wherein said first coupling member is a unitary molded member and said second coupling member is a unitary molded member.

3. The article of apparel of claim 2, wherein said article of apparel is a bra.

4. The article of apparel of claim 3, said hook includes a receiving slot and a locking projection disposed therein.

5. The article of apparel of claim 4, wherein said proximal portion of said first coupling member is fixedly sewn to said first portion, and said proximal portion of said second coupling member is fixedly sewn to said second portion.

6. The article of apparel of claim 5, wherein said first coupling member includes two spaced apart hooks, and said second coupling member includes two spaced apart loops, wherein said first coupling member includes a groove between its spaced apart hooks to enhance flexibility of the first coupling member between its hooks, and said second coupling member includes a groove between its spaced apart loops to enhance flexibility of the second coupling member between its loops.

7. The article of apparel of claim 6, wherein said loop includes a locking surface and a pair of opposed shoulders disposed on opposite sides of said locking surface.

8. An article of apparel comprising:

first and second portions, said first and second portions adapted for covering a portion of a body of a wearer;

a fastening system, said fastening system adapted for removably coupling said first and second portions together, said fastening system including:

a first coupling member attached to said first portion of the article, said first coupling member having a first locking member and a second locking member, said first locking member of the first coupling member having a hook including a receiving slot and said second locking member of the first coupling member having a hook including a receiving slot, said first coupling member being integrally formed with its first and second locking members; and a second coupling member attached to said second portion of the article, said second coupling member having a first locking member and a second locking member, each of said first and second locking members of the second coupling member including a loop defining an opening, said loop being at least partially formed by a support having first and second guiding surfaces, an engagement surface disposed between the first and second guiding surfaces, and a pair of opposed shoulders disposed on opposite sides of said engagement surface, said support having a smaller cross-section at a point between the shoulders than at the shoulders, wherein said first guiding surface of said first locking member of said second coupling member is substantially parallel to said first guiding surface of said second locking member of said second coupling member, and said second guiding surface of said first locking member of said second coupling member is substantially parallel to said second guiding surface of said second locking member of said second coupling member, said second coupling member being integrally formed with its first and second locking members;

said first and second coupling members being movable between a first locked state whereby the hooks of said first coupling member lockingly engage respective engagement surfaces of said second coupling member to couple said first and second portions of the apparel together, and a second unlocked state whereby the first and second portions of the apparel are freely movable with respect to each other.

9. The article of apparel of claim 8, wherein said article of apparel is a bra.

10. The article of apparel of claim 9, wherein each said hook includes a receiving slot and a locking projection disposed therein.

11. The article of apparel of claim 9, wherein said first coupling member includes two spaced apart hooks, and said second coupling member includes two spaced apart loops, wherein said first coupling member includes a groove between its spaced apart hooks to enhance flexibility of the first coupling member between its hooks, and said second coupling member includes a groove between its loops to enhance flexibility of the second coupling member between its loops.

12. The article of apparel of claim 11, wherein said first coupling member further includes a base plate, said base plate of said first coupling member being fixedly sewn to said first portion, and wherein said second coupling member further includes a base plate, said base plate of said second coupling member being fixedly sewn to said second portion.

13. The article of apparel of claim 12, wherein said base plate of said first coupling member includes a flex groove and said base plate of said second coupling member includes a flex groove.

14. An article of apparel comprising:

first and second portions, said first and second portions adapted for covering a portion of a body of a wearer;

a fastening system, said fastening system adapted for removably coupling said first and second portions together, said fastening system including:

a first coupling member attached to said first portion of the article, said first coupling member having a first locking member and a second locking member, said first locking member of the first coupling member having a hook including a receiving slot and said second locking member of the first coupling member having a hook including a receiving slot, said first coupling member being integrally formed with its first and second locking members; and a second coupling member attached to said second portion of the article, said second coupling member having a first locking member and a second locking member, each of said first and second locking members of the second coupling member including a loop defining an opening, said loop being at least partially formed by a support rail having first and second guiding surfaces and an engagement channel formed by a reduced cross-section recess in the support rail and disposed between said first and second guiding surfaces, wherein said first guiding surface of said first locking member of said second coupling member is substantially parallel to said first guiding surface of said second locking member of said second coupling member, and said second guiding surface of said first locking member of said second coupling member is substantially parallel to said second guiding surface of said second locking member of said second coupling member, said second coupling member being integrally formed with its first and second locking members;

said first and second coupling members being movable between a first locked state whereby the hooks of said first coupling member lockingly engage respective engagement channels of said second coupling member to couple said first and second portions of the apparel together, and a second unlocked state whereby the first and second portions of the apparel are freely movable with respect to each other.

15. The article of apparel of claim 14, wherein said article of apparel is a bra.

16. The article of apparel of claim 15, wherein each said hook includes a receiving slot and a locking projection disposed therein.

17. The article of apparel of claim 15, wherein said first coupling member includes two spaced apart hooks, and said second coupling member includes two spaced apart loops, wherein said first coupling member includes a groove between its spaced apart hooks to enhance flexibility of the first coupling member between its hooks, and said second coupling member includes a groove between its loops to enhance flexibility of the second coupling member between its loops.

18. The article of apparel of claim 17, wherein said first coupling member further includes a base plate, said base plate of said first coupling member being fixedly sewn to said first portion, and wherein said second coupling member further includes a base plate, said base plate of said second coupling member being fixedly sewn to said second portion.

19. The article of apparel of claim 18, wherein said base plate of said first coupling member includes a flex groove and said base plate of said second coupling member includes a flex groove.

* * * * *